United States Patent [19]

Inaba

[11] Patent Number: 4,671,692

[45] Date of Patent: Jun. 9, 1987

[54] WRITING PEN HOLDER WITH THREE WICKS

[75] Inventor: Takao Inaba, Aichi, Japan

[73] Assignee: Pilot Ink Co., Ltd., Nagoya, Japan

[21] Appl. No.: 769,918

[22] Filed: Aug. 27, 1985

[30] Foreign Application Priority Data

Aug. 29, 1984 [JP] Japan ..... 59-130840[U]

[51] Int. Cl.[4] ..... B43K 8/02; B43K 7/10; B43K 5/18

[52] U.S. Cl. ..... 401/199; 401/209; 401/217

[58] Field of Search ..... 401/214–224, 401/198, 199, 258, 260, 259, 225, 209

[56] References Cited

U.S. PATENT DOCUMENTS

| | | | |
|---|---|---|---|
| 2,694,382 | 11/1954 | Miessner | 401/225 |
| 3,290,717 | 12/1966 | Mizutani | 401/199 |
| 3,951,555 | 4/1976 | Wittnebert et al. | 401/217 |
| 4,239,408 | 12/1980 | Mutschler | 401/217 |
| 4,382,707 | 5/1983 | Anderka | 401/199 |
| 4,522,525 | 6/1985 | Saito et al. | 401/259 |

FOREIGN PATENT DOCUMENTS

| | | | |
|---|---|---|---|
| 173131 | 11/1952 | Fed. Rep. of Germany | 401/209 |
| 1250302 | 9/1967 | Fed. Rep. of Germany | 401/199 |
| 1259733 | 1/1968 | Fed. Rep. of Germany | 401/225 |
| 1911951 | 3/1969 | Fed. Rep. of Germany | 401/259 |
| 914582 | 12/1946 | France | 401/258 |
| 443439 | 12/1948 | Italy | 401/209 |
| 18295 | 1/1982 | Japan | 401/209 |
| 663951 | 1/1952 | United Kingdom | 401/228 |
| 2122953 | 1/1984 | United Kingdom | 401/209 |

*Primary Examiner*—Steven A. Bratlie

*Attorney, Agent, or Firm*—Sughrue, Mion, Zinn, Macpeak, and Seas

[57] ABSTRACT

A writing pen having good ink flow control to a tip suitable for fine writing over a wide range of atmospheric pressure and ambient temperature. The pen has a flow-regulator composed of first, second and third ink supply rods connected in series. The flow-regulator has a plurality of fins around its circumference which cooperatively define a labyrinth groove. The spacing between fins varies from the front end to the rear end of the flow-regulator, with the widest spacing occurring at the front end, towards the writing tip of the pen.

5 Claims, 10 Drawing Figures

WRITING PEN HOLDER WITH THREE WICKS

BACKGROUND OF THE INVENTION

The present invention relates to a writing pen. More particularly, the invention relates to a writing pen of the type in which a flow-regulator having an outer circumference formed with a labyrinth groove is interposed between the writing tip and an ink reservoir in a pen barrel and in which an ink supply rod is fitted in an internal through-bore of the flow-regulator. Yet more specifically, the invention relates to a writing pen having an improved flow-regulator which is suitable for supplying ink to a fine writing tip and in which first, second and third ink supply rods are connected in series in the internal through-bore of the flow-regulator.

There has been proposed in the art a writing pen of the type in which an ink supply rod is fitted in an internal through-hole of a flow-regulator having its circumference formed with a labyrinth groove thereby to control the flow of ink to the writing tip. Examples of such pens are disclosed in U.S. Pat. Nos. 4,239,408 and 4,382,707. However, the pens of these proposals do not satisfactorily solve the requirements of ink flow control to a tip suitable for fine writing over wide ranges of atmospheric pressure and ambient temperature. This will be described below more in detail.

In a writing pen having an ink supply rod inserted into a flow-regulator, the distance from the ink reservoir to the writing tip is greater than in a pen having no flow-regulator due to the axial length occupied by the flow-regulator. In a pen as disclosed in the above-mentioned U.S. Pat. No. 4,382,707, which pen employs a single ink supply rod, the ink supply rod is unable to supply ample ink to the writing tip if the supply rod is desirably thin. Alternatively, in the case of a tubular body formed with an ink passage extending straightly in the axial direction, if an impact force is imposed on the pen or the pen is held upright for a significant period of time, the ink is liable to be forced back toward the reservoir away from the tip, making it impossible to write with the pen. Therefore, the ink supply rod in a pen of this kind has to have a relatively large diameter and be made of a porous material. Unavoidably, the external diameter of the flow-regulator is accordingly made larger, making it difficult to design a pen having a thin body, resulting in a pen construction suitable only for a writing pen having a wide point and a relatively thick body.

On the other hand, a pen using a combination of two different ink supply rods, as disclosed in U.S. Pat. No. 4,239,408, is more suitable for use with a fine writing tip than the pen using a single ink supply rod, but this pen is disadvantageous in that it suffers from a danger of ink leakage.

SUMMARY OF THE INVENTION

An objective of the present invention is to provide a writing pen in which ink flow is controlled so as to ensure suitable ink supply at any writing speed over wide range of atomospheric pressure and ambient temperature.

Another objective of the invention is, while avoiding excessive ink flow of ink leakage, to make the pen body thinner and easier to carry.

In order to eliminate inconveniences found in conventional pens such as excessive ink supply or ink leakage, the pen according to the present invention has a flow-regulator in which first, second and third ink supply rods are connected in series. While maintaining their functions as individual ink supply rods, they can exhibit much improvement when used in combination. The flow-regulator thus structured is free from excessive ink supply or ink leakage from the writing tip due to abrupt changes of atmospheric pressure or ambient temperature. Further, the flow-regulator is advantageous for easier fabrication.

BRIEF DESCRIPTION OF THE DRAWING

Objectives of the present invention as well as advantages will be clear from the following detailed description.

DESCRIPTION OF THE PREFERRED EMBODIMENTS

Figure 1:
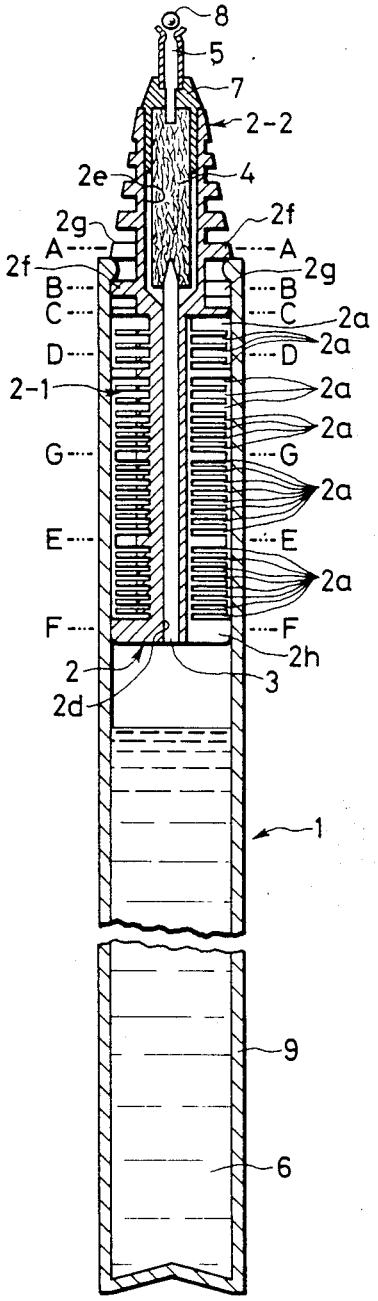
FIG. 1 is a longitudinally sectional front elevation showing a pen of a preferred embodiment of the present invention.

The writing pen according to the present invention is characterized in the structure of the flow-regulator and ink supply rods employed therein. The present invention is described more in detail in the following with reference to the accompanying drawings.

A flow-regulator 2 is composed of a body 2-1 and a cylindrical shell 2-2. The body 2-1 includes a labyrinth groove 2*a* consisting of a plurality of fins, the distance between which increases toward the pen tip, an ink groove 2*b* having a smaller width than the smallest separation of the fins of the labyrinth groove 2*a*, an air ventilation groove 2*c*, and a center bore 2*d* extending along the longitudinal axis of the body. The cylindrical shell 2-2 extends from the pen body and includes a bore 2*e* having a larger diameter than the center bore 2*d*. These two bores are communicated with each other.

The separate functions of the labyrinth groove 2*a*, the ink groove 2*b* and the air ventilation groove 2*c* have per se been known. They include the elimination of excessive ink supply or ink leakage through the tip in the case of small quantity of ink left in the ink reservoir 6 or in the case of abrupt changes of ambient temperature or pressure.

The present invention employs a combination of these known functions to obtain improved writing characteristics. To be more specific, the ink groove 2*b* is narrower than the smallest separation of the fins so that excessively supplied ink, if any, may be sucked and stored in the labyrinth groove 2*a* by capillary action. The distance between the fins increases towards the writing tip. In other words, their separation becomes smaller towards the ink reservoir so as to provide a better capillary function such that ink from the ink groove 2*b* is first retained. This structure prevents ink supplied through the ink groove 2*b* from directly flowing into the anterior end of the labyrinth groove 2*a*, thereby reducing the danger of ink leakage or excessive ink supply.

In order to ensure these advantages and avoid a danger of excessive ink supply, the labyrinth groove 2a at its frontmost end has a fin spacing of about 1.3 to 3 times larger than an adjoining fin spacing. This structure ensures that ink does not directly flow into the frontmost area.

The labyrinth groove 2a herein disclosed is intended to cause capillary action with fins provided at a spacing of 0.1 to 1.1 mm. Such grooves are easy to mold.

The labyrinth groove 2a can have different fin spacings. However, the groove exhibits preferable performance when it consists of several sections and each section has a plurality of fins placed at equal distances. The section in the frontmost portion of the groove has the largest spacing and sections away from the tip have gradually smaller spacings. The use of either gradually changing spacing (spacing changes groove by groove) or staged spacing (spacing changes every predetermined number of grooves) can be determined taking the actual size of the labyrinth grooves and the molding feasibility into consideration.

Figure 5:
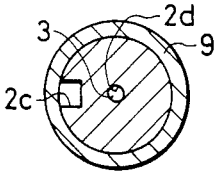
Figure 6:
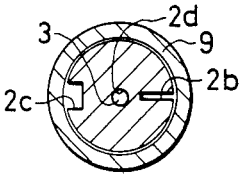
Figure 7:
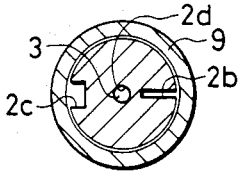
Figure 8:
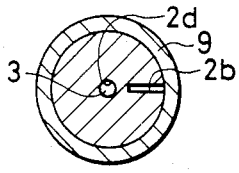
Figure 9:
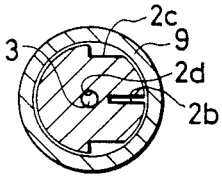
FIG. 9 is a transverse section along a line G—G of FIG. 1, which shows another example of an air ventilation groove.
Figure 10:
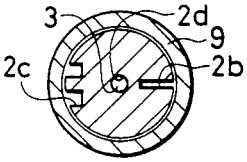
FIG. 10 is a transverse section along a line G—G of FIG. 1, which shows still another example of the air ventilation groove.

The air ventilation groove 2c, formed longitudinally on the labyrinth groove 2a, is sealed at its posterior end with an annular flange 2h, while its anterior end is connected to an air hole 2g at a front annular flange 2f thereby to allow free air ventilation. The air ventilation groove is formed by cutting away the outer circumference of the flow-regulator linearly in the axial direction as shown in FIGS. 5 to 7. However, the air ventilation groove may be formed in such a manner that a cutting portion provided on at least one of the fins positioned at the middle of the flow-regulator is not aligned to a cutting portion provided on the fin adjoining to said one of the fins as shown in FIGS. 9 or 10, so that air goes round. In this case, even if an ink retained in the labyrinth groove 2a flows toward the tip of the writing pen through the air ventilation groove due to the change in the inner pressure when a cap is taken off under the condition of rapid change in temperature or pressure, the flow is interrupted by the fin positioned at the middle of the flow-regulator. Accordingly, the pollution due to the blowing off of the ink from the air hole 2g in the tip of the writing pen is prevented, thus the security is further improved.

The center bore 2d is provided at the center of the labyrinth groove 2a, thereby constituting the main body 2-1. The cylindrical shell 2-2 with a second bore 2e on its axis extends from the anterior end of the main body 2-1.

The first ink supply rod 3 and the second ink supply rod 4 are inserted into the center bore 2d and second bore 2e, respectively. These two rods are connected to each other. A tip holder 7 inserted a third ink supply rod 5 is fitted to the second bore 2e at its anterior end. The third ink supply rod 5 is connected to the second ink supply rod 4.

The cylindrical shell 2-2 is smaller than the main body 2-1 in diameter. The anterior end of the shell 2-2 constitutes a writing tip. The posterior end thereof is provided with an annular flange 2f having an air hole 2g. The cylindrical shell 2-2 thus formed is inserted into the anterior end of the pen barrel 9, thereby to constitute a pen body. To ensure correct insertion, an annular ridge is formed on the inner surface of the anterior end of the pen barrel.

The following description relates to the connection of the three different ink supply rods in combination with the flow-regulator 2.

The first ink supply rod 3 is inserted into the center bore 2d and is communicated with, at its posterior end, the ink reservoir 6, and, at its anterior end, with the second ink supply rod 4 inserted into the second bore 2e. The second ink supply rod 4 is connected at its anterior end to the third ink supply rod 5 secured in the tip holder 7. Thus, the first, second and third ink supply rods are connected in series.

In the pen body, ink in the reservoir 6 rises initially through the first ink supply rod 3 by capillary force and is supplied to the second ink supply rod 4. The second ink supply rod 4, filled with a porous material, acts to retain incoming ink for a time. The third ink supply rod 5 sucks reserved ink by means of capillary action, enabling the supply of ink to the writing tip.

The first ink supply rod 3 can be various rods such as a rod having an ink passages bored through the axis of straight fibers, or a rod of axial projections or slits around the surface. In the case of the rods, however, the inherent resistance against ink flow should be as small as possible and the bar should be provided with a straight ink passage to assure smooth capillary action.

The second ink supply rod 4 is larger in diameter and more porous than the first ink supply rod 3. To be more specific, the porous material is a thermally fused material of fibers, a resin-treated fiber material or felt of chemically processed resin fibers having a porosity of approximately 50 to 80%.

The third ink supply rod 5, which is thinner in diameter than the second ink supply rod 4, can have various shapes. For example, an ink passage can be formed in the axial direction and surface undulated cores also provided. Other materials such as chemically processed fibers may be used if they are arranged in such a manner as to cause capillary action with the use of a capillary tube. Further, the ink supply rod 5 itself may constitute the writing tip, or it may hold a ball at the writing tip such that ink is suitably supplied to the back of the ball. In some applications, a writing member can have a structure with a capillary tube. The anterior end of the tube is narrowed to suitably supply the ink to the writing tip.

As discussed above, the connection of the three different ink supply rods in series provides a suitable ink supply and adequate ink storage. The thus-improved structure is applicable to a fine writing pen where a controlled ink supply is necessary at any writing speed and where ink should not be forced back to the reservoir.

The flow-regulator 2 is made of an integrated injection molding of plastics. The main body 2-1 is provided with an annular flange 2h in 2 mm thickness at its posterior end. The section closer to the reservoir has eight fins which are spaced at a distance of 0.2 mm. The adjoining section in the direction of the pen tip has 8 fins spaced at a distance of 0.25 mm. The next section in the same direction has four fins with a 0.3 mm spacing. Toward the pen tip, there are three more sections: a section of three fins with 0.4 mm spacing, a section of three fins with a 0.6 mm spacing, and a section of one fin spaced 1 mm apart from the adjoining section. These fins constitute a labyrinth groove.

The ink groove 2b, having a preferable of about 0.15 mm, extends longitudinally through the labyrinth groove 2a and the annular flange 2h. The air ventilation groove 2*c* has a width of 1.5 mm. The center bore 2*d*, preferably about 1.0 mm in diameter, extends in the axial direction. The air ventilation groove 2*c* has an opening at the area connected to the annular flange 2*f* to constitute the air hole 2*g*.

The center bore 2*d* is communicated with the second bore 2*e*, which is 2.5 mm in diameter at the anterior end of the main body 2-1. The second bore 2*e* and the annular flange 2*f* with the air hole 2*g* constitute the cylindrical shell 2-2.

The flow-regulator 2 has a center bore 2*d* in which the first ink supply rod 3 (plastic bar having an capillary ink passage bored through the axis of the interior of the bar, external diameter=1.0 mm, total length=29 mm) is inserted. The second ink supply rod 4 (a resin treated fiber material, external diameter=1.6 mm, total length 10 mm, porosity =approximately 62%) is inserted into the second bore 2*e*. The tip holder 7 is firmly provided at the anterior end of the second bore 2*e*. The tubular tip holding a ball 8 of 0.5 mm in diameter is inserted to the tip holder 7. The third ink supply rod 5 (plastic, external diameter=0.8 mm, total length=7 mm) extends to the ball to supply ink. Of course, the third ink supply rod 5 is connected to the anterior end of the second ink supply rod 4.

The pen barrel 9 is filled with a predetermined quantity of water-based ink. The flow-regulator 2, fabricated in the manner discussed above, is firmly coupled to the pen barrel 9 such that the flange 2*g* firmly engages with the anterior end of the pen barrel 9.

Figure 2:
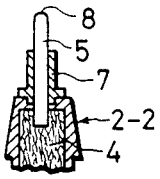
FIG. 2 is a longitudinally sectional elevation showing a writing tip of another embodiment.
Figure 3:
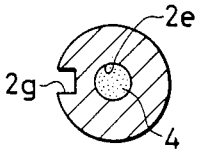
FIGS. 3, 4, 5, 6, 7 and 8 are transverse sections along lines A—A, B—B, C—C, D—D, E—E and F—F of FIG. 1 respectively.
Figure 4:
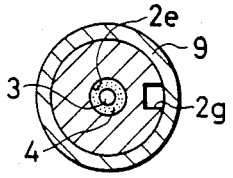

Another embodiment shown in FIG. 2 has a writing tip which constitutes a part of the third ink supply rod 5. The third ink supply rod, with an external diameter of 1.0 mm and a total length of 20 mm, includes an ink passage extending therethrough. The anterior end of the third ink supply rod 5 is tapered, such as by a grinding treatment. With respect to the other parts, the discussion of the first embodiment is applicable.

The writing pen according to the present invention includes, as has been described hereinbefore, a flow-regulator and three ink supply rods connected in series and which are provided between a flow-regulator and a writing tip. With this arrangement, a writing pen is provided which ensures a controlled ink supply for fine writing and provides an improved structure free from adverse affects from changes in pressure or temperature. Even if a small quantity of ink is left in the ink reservoir, excessive ink flow can be avoided and proper ink supply can be assured for comfortable writing. This structure allows the diameter of the center bore to be made smaller, resulting in a thinner pen core. Here, emphasis is put on the temporary storage function of ink in the second ink supply rod 4. This function ensures a smooth start of writing, even if the pen has been held upright for a significant period of time or the pen suffers an impact force. Resolving the setback of the conventional pen whereby the ink is forced back to the reservoir, the pen according to the invention satisfies the requirements of comfortable writing feasibility and practical portability.

I claim:

1. A writing pen having a flow-regulator having a labyrinth groove in its circumference interposed between a writing tip and an ink reservoir in a pen barrel, and in which an ink supply rod is inserted into the bore of the flow-regulator to guide ink to the writing tip, wherein the improvement comprises:

a body including a labyrinth groove defined by a plurality of fins in which a spacing between fins gradually increases toward said writing tip, an ink groove formed in an outer circumference of said flow-regulator and having a width smaller than a smallest spacing between said fins of said labyrinth groove, an air ventilation groove formed in said outer circumference of said flow-regulator, a center bore extending through said flow-regulator along a longitudinal axis thereof, and a first ink supply rod inserted into said center bore, a posterior end of said first ink supply rod being communicated with the ink reservoir;

a cylindrical shell extending from an anterior end of said body including a second bore having a larger diameter than said center bore and being communicated with said center bore, said second bore being fitted to said first ink supply rod, a second ink supply rod made of a porous material having a larger diameter than said first ink supply rod and being inserted into said second bore and having an anterior end connected to a posterior end of a third ink supply rod inserted into a tip holder fitted in an anterior end of said second bore said second ink supply rod having a greater ink storage capacity than any other ink supply rod, thereby to guide ink to said writing tip.

2. The writing pen according to claim 1, wherein said first ink supply rod and said third ink supply rod are made of members having straight ink passages in longitudinal directions thereof, and said second ink supply rod made of a porous material made of chemically processed fibers and having a porosity of 50 to 85%.

3. The writing pen according to claim 1, wherein said labyrinth groove has a width at a frontmost position thereof approximately 1.3 to 3.0 times larger than a width of an adjoining groove.

4. The writing pen according to claim 1, wherein said fins, except for a fin at a forwardmost position, are arranged in a plurality of sections, each section having a uniform fin spacing therein, and a section closer to said pen tip having a relatively larger fin spacing than sections posterior thereto.

5. The writing pen according to claim 1, wherein said air ventilation groove is constructed in such a manner that a cutting portion provided on at least one of said fins positioned at the middle of said flow-regulator is not aligned to a cutting portion provided on a fin adjoining one of said fins, so that air goes around.

* * * * *